US006965230B2

(12) United States Patent
Rogers et al.

(10) Patent No.: US 6,965,230 B2
(45) Date of Patent: Nov. 15, 2005

(54) APPARATUS AND METHOD FOR DETERMINING THE POSITION OF THE END OF A THREADED CONNECTION, AND FOR POSITIONING A POWER TONG RELATIVE THERETO

(76) Inventors: Tommie L. Rogers, 702 Crestlawn Dr., Lafayette, LA (US) 70503; Geoffrey King, 26203 Production Ave., Suite 10, Hayward, CA (US) 94545

( * ) Notice: Subject to any disclaimer, the term of this patent is extended or adjusted under 35 U.S.C. 154(b) by 0 days.

(21) Appl. No.: 11/018,703

(22) Filed: Dec. 21, 2004

(65) Prior Publication Data

US 2005/0104583 A1 May 19, 2005

Related U.S. Application Data

(63) Continuation of application No. 10/429,097, filed on May 2, 2003, now abandoned.

(60) Provisional application No. 60/452,400, filed on Mar. 6, 2003.

(51) Int. Cl.[7] ..... G01N 27/72
(52) U.S. Cl. ..... 324/220; 324/207.16; 324/207.17
(58) Field of Search ..... 324/207.16–207.17, 324/220–221, 226, 239; 81/57.16, 57.24, 81/57.35; 166/77.51, 85.1, 85.5, 298, 337–380, 166/77.53; 414/22.51, 22.71, 767

(56) References Cited

U.S. PATENT DOCUMENTS

| | | | | |
|---|---|---|---|---|
| 2,692,059 | A * | 10/1954 | Bolling, Jr. | 414/22.51 |
| 3,780,815 | A * | 12/1973 | Barron et al. | 173/195 |
| 3,840,128 | A * | 10/1974 | Swoboda et al. | 414/728 |
| 3,881,375 | A * | 5/1975 | Kelly | 81/57.35 |
| 4,274,778 | A * | 6/1981 | Putnam et al. | 414/22.71 |
| 6,318,214 | B1 * | 11/2001 | Buck | 81/57.35 |
| 6,720,764 | B2 * | 4/2004 | Relton et al. | 324/235 |
| 6,803,757 | B2 * | 10/2004 | Slates | 324/207.17 |

* cited by examiner

*Primary Examiner*—Bot Ledynh
*Assistant Examiner*—Reena Aurora
(74) *Attorney, Agent, or Firm*—Jesse D. Lambert

(57) ABSTRACT

Apparatus and method for positioning a power makeup/breakout device, commonly referred to as a "power tong unit," along the longitudinal axis of a tubular, with respect to the end of a connection. A probe having an electric coil is mounted on the power tong. An alternating electric current is flowed through the coil, creating an electro-magnetic field emanating from the coil. Positioning the coil such that the tubular connection is within the magnetic field, then moving the coil such that the connection end moves within the magnetic field, permits the connection end to be seen as a discontinuity, by the principles of eddy current testing. The location of the connection end is used to manually position the tong, or is input to a processor and then to a power positioner, which properly positions the power tong with respect to the connection end.

14 Claims, 4 Drawing Sheets

APPARATUS AND METHOD FOR DETERMINING THE POSITION OF THE END OF A THREADED CONNECTION, AND FOR POSITIONING A POWER TONG RELATIVE THERETO

CROSS REFERENCE TO RELATED APPLICATION

This application is a continuation of application Ser. No. 10/429,097 now abandoned, and claims priority to the filing date of that application (May 2, 2003) and also to provisional patent application No. 60/452,400, filed Mar. 6, 2003.

BACKGROUND

1. Field of Art

This invention relates to method and apparatus used in connection with the handling of threaded tubulars. More particularly, this invention relates to method and apparatus used to position power makeup/breakout devices with respect to the end of a threaded connection half (of a threaded connection joining joints of tubular goods), in order that the power makeup/breakout device may either makeup (that is, screw together) or breakout (that is, unscrew) the threaded connection.

2. Related Art

Tubular goods manufactured in "joints," typically on the order of 30 to 40 feet long, are commonly joined together to make up very long tubular strings, at times on the order of tens of thousands of feet long. While some tubular goods joints are welded together, commonly some sort of threaded connection is used, which permits the joints to be screwed together to form the tubular string, then unscrewed when needed.

Tubulars having threaded connections on either end are used in many industries, including but not limited to the oil and gas industry, borehole drilling, the drilling of pipeline crossing bores, and in a myriad of industrial settings such as chemical plants, manufacturing facilities, and the like. While the scope of the present invention is not restricted to any particular setting or use of tubulars having threaded connections, for illustrative purposes the following description will focus on tubulars used in the drilling of earthen boreholes for oil and gas wells, in particular drill pipe. Joints of drill pipe are usually joined by threaded connections commonly known as "tool joints." The threaded connection is comprised of two halves: one half is the box, which contains the female threads, while the other half is the pin, containing the male threads. FIG. 1 shows a typical tool joint, not made up (that is, the pin not engaged in the box). The ends of the respective connection halves are also shown in FIG. 1. As can be seen in FIG. 1, an "upset" or larger outer diameter section is commonly present on both halves of the connection. The upset provides greater strength and provides a gripping surface for the tongs used to make up and breakout the connection. FIG. 1A shows the same threaded connection made up. The line at which the ends of the pin and box halves of the connection meet, for purposes of this application, is referred to as the "connection seam." Similarly, a "connection end" is simply the end of a threaded connection, for example the end of the box connection, as shown in FIG. 1. For purposes of this application, the term "connection end" will encompass also the seam marking where two connection ends meet.

Traditionally, tool joints were made up and broken out with "manual" tongs, which hung from the rig derrick via cables and were swung into place onto the tool joint by the rig workers. The rig drawworks were then used to pull on the tongs (via cables), to makeup or break out the connection. Manual tongs are quite heavy, can be relatively slow to use, and require at least one rig worker for each tong (the "lead tong" and "backup tong"). For these and a variety of other reasons, including safety and efficiency reasons, combined power tong/backup units have come into common use on rigs to makeup and break out threaded connections. Power tong/backup units, while available in a variety of configurations, generally have a "power tong" section which has a set of powered rotary jaws, powered usually by hydraulic means, coupled to a "backup" section, which has hydraulic means to grip the connection and hold it stationary. The backup holds one side of the connection stationary, while the power tong turns the other side to makeup or break out as desired. For illustrative purposes, power tong/backup units and their use will be described for an arrangement with the power tong positioned over or above the backup. However, it is understood that an inverted arrangement is possible.

It is to be understood that the scope of the invention herein encompasses any sort of powered device to make up, and/or break out, threaded connections. For brevity, such devices (including the above-described power tong/backup units) may be referred to at times in this application as a "power tong unit." Regardless of the configuration, it is readily appreciated that the power tong unit must be positioned so that one side of the power tong unit is grasping one side of the connection, while the other side of the power tong unit is grasping the other side of the connection end. The term "power tong unit" as used herein also encompasses the power tong half alone (that is, for example, used in conjunction with some sort of detached backup).

While power tong units can be suspended from the rig derrick by a cable, and swung into and out of engagement with the connection, powered positioning devices in various configurations have now come into use. Various configurations of such powered positioning devices comprising booms, rails, etc. are in use. Such positioning devices enable the operator to move power tong units horizontally into proper position to enable the tong jaws to grip the connection, and vertically into position with respect to the connection seam, with the power tong on one side of the seam and the backup on the other side. The operator moves the power tong unit into proper position by visually sighting the connection, particularly the connection seam. Obviously, the operator must stand relatively close to the connection to do so, and may have to contend with his line of sight being partially blocked by the power tong itself or other machinery.

For purposes of this application, the term "power positioner" is used at times to refer to any type or configuration of powered (whether by hydraulic or other means) device which at least partially positions a power tong unit on a connection.

This situation gives rise to the desirable goal of, at least partially, automating the positioning of the power tong on the connection. When manipulating threaded connections in rig operations, the position of the connection in a horizontal plane is always (within reasonably close tolerances) centered in the rotary drive of the rig. Therefore, automation of the horizontal element of power tong positioning is relatively easy.

However, the vertical position of the connection end with respect to the rig floor is a variable. The tubular is not set into the slips in the rotary table at a consistent height above the rotary table for every connection, therefore the position of the connection end above the rig floor will vary from connection to connection.

It can be readily appreciated that in order to automate tong positioning (that is, to position the tong on the connection with minimal human guidance) the height of the connection end with respect to some datum, for example above the rig floor, must first be determined, then that information must be input to a power positioner to vertically position the power tong unit along the longitude of the tubular (in addition to horizontal positioning).

Other applications have similar positioning needs. For example, in so-called "shop" environments, the power tong unit may be stationary and oriented to grasp substantially horizontally positioned tubulars; the tubular is placed horizontally, for example, on a powered roller. With this arrangement, rather than the power tong unit being moved with respect to stationary tubular, the power tong unit is stationary, and the tubular is moved by the roller so as to properly position the connection end with respect to the power tong.

Prior art methods and/or apparatus which have attempted to locate the connection end are believed to include mechanical devices such as feelers, and optical devices such as lasers. However, these prior art apparatus and methods are believed to exhibit various limitations on their use.

"Eddy Current" Techniques for Connection End Detection

It is known in the prior art to use so-called "eddy current" principles to detect discontinuities in the shape or structure of electrically conductive materials. For the present invention, eddy current principles are used to detect a "discontinuity" in electrically conductive tubulars, in the form of the connection end—whether the connection end marks the top or bottom of the tubular, as when only one of the connection halves is in place and the discontinuity is due to no material present past the connection end; or whether the connection end forms a connection seam, which, with respect to the tubular on either side of it, is a discontinuity, in that the seam marks where two separate pieces of electrically conductive material (metal) meet.

An alternating electric current, preferably a radio frequency alternating current, is flowed through at least one electric coil which is usually disposed in a housing and the resulting assembly commonly referred to in the art as a "probe." An electro-magnetic field is thereby created around the probe. Impedance (generally, resistance to electric current flow), current, and phase angle can all be measured for the electric coil. These values can be measured, in a first or "undisturbed" state (that is, with unchanging presence of an electrically conductive object within the electro-magnetic field). Thereafter, an electrically conductive object (the object being examined to detect discontinuities therein) is moved within and relative to the electro-magnetic field, either by moving the electrically conductive object, or moving the coil. By principles well known to those in the relevant art, discontinuities in the electrically conductive object, for example, cracks, voids, or the like, both on and below the surface, can be detected by noting a change in the measured impedance, current or phase angle of current through the electric coil, as compared to the impedance when the discontinuity is not present within the magnetic field. The size and number of electric coils, geometry of the coils and/or housing, proximity of the electric coils to the object being tested, frequency of alternating current, voltage, etc. can be varied to accommodate particular applications, conditions to be investigated, etc. Inspection of various electrically conductive objects, especially metallic objects in the form of tubular goods, plates, fasteners, etc. may be carried out, to find discontinuities in the objects.

The present invention utilizes these principles in a novel method and apparatus for determining the position of a connection end on a tubular workpiece, to position power tongs on the threaded connection. A "discontinuity" in the form of the connection end is detected, and then the connection end and power tong unit (comprising a power tong alone, or combined power tong and backup) are properly positioned relative to one another, either by moving the power tong unit or the tubular or both.

SUMMARY OF THE INVENTION

This invention comprises a method and apparatus for positioning a power tong unit along the longitude of a tubular, with respect to a connection end on a electrically conductive tubular workpiece. In one preferred embodiment, the invention comprises a probe comprising at least one electric coil, the coil carried by the power tong unit, for example mounted on the backup portion thereof. Typically, the coil is disposed in a housing, and the coil/housing unit referred to as a probe. The face of the probe is positioned at or close to the edge of the throat of the power tong unit, typically within about ½" of the throat edge. A radio frequency alternating electric current source, supplies an alternating electric current to the probe. A measuring means, which can measure impedance, current and phase angle for the current flow through the electric coil, is provided. A means for detecting changes in impedance, current and/or phase of the current flow through the electric coil, such as a processor, said changes indicative of a discontinuity in the tubular, emits a signal when such changes are detected. The signal can cause an audio and/or visual alarm, for detection by an operator and manual control of a power positioner to place the tong in the proper location. Alternatively, the power positioner can be coupled to the means for detecting impedance and other changes, receiving the signal with (for example) a second processor which utilizes various positional data and the connection end detection data to automatically position the power tong unit on the connection.

In another embodiment of the apparatus, the power tong unit is held stationary while a tubular positioner moves the tubular into the proper position relative to the power tong unit.

The corresponding method of the present invention comprises the steps of:

- providing a probe comprising at least one electric coil, and flowing an alternating electric current through the coil, while the probe is positioned sufficiently close to an electrically conductive tubular that the tubular is within the electro-magnetic field thus generated;
- moving the tubular and the electric coil relative to one another, whether by moving the tubular with the probe held stationary or by moving the electric coil with the tubular held stationary, a sufficient distance that the connection end is moved within the magnetic field;
- detecting the presence of the connection end by monitoring impedance, current and/or phase angle for the electric coil, for a change indicative of the connection end;
- correlating the relative positions of the power tong unit along the longitude of the tubular and the position of the connection end; and
- manually controlling a power positioner to place the power tong unit on the connection, or signaling a power positioner to move the power tong unit along the longitude of the tubular, or alternatively moving the tubular, to a position where the power tong unit is properly positioned thereto, in position to advance transverse to the tubular and grasp it for makeup or breakout.

DESCRIPTION OF THE PRESENTLY PREFERRED EMBODIMENTS

Those having skill in the relevant art field will recognize that many changes may be made to the preferred embodiments described herein, without departing from the spirit of the invention. However, with reference to the drawings, some of the presently preferred embodiments will now be described. For convenience only, one embodiment of the invention is described in conjunction with one application, that being the makeup and breakout of threaded connections on drill pipe or other tubulars, such as on a drilling rig. However, the scope of the invention is not limited to that specific application.

This invention comprises a method and apparatus for detecting the position of a tubular threaded connection end, and using that positional information to properly place a power tong unit (via a power positioner) onto the connection, to permit either making up or breaking out the threaded connection. For purposes of this patent application, the term "power tong unit" encompasses any type of power tong, power tong and backup combination, power makeup/breakout device, or any other powered device which grips the tubular and rotates it, to make up or break out a connection. The term "power positioner" is to be construed to refer to any device which moves a power tong unit vertically and/or horizontally with respect to a tubular, in order to place the power tong unit correctly onto the tubular.

Figure 1:
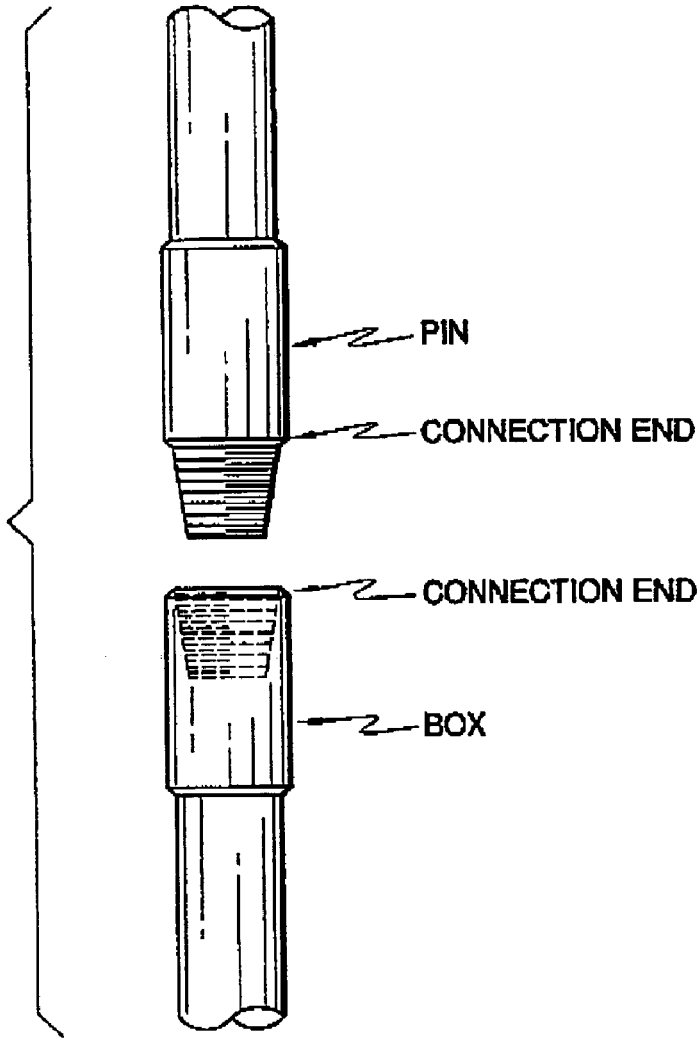
FIG. 1 shows a typical tubular threaded connection, not made up (or screwed together).
Figure 2:
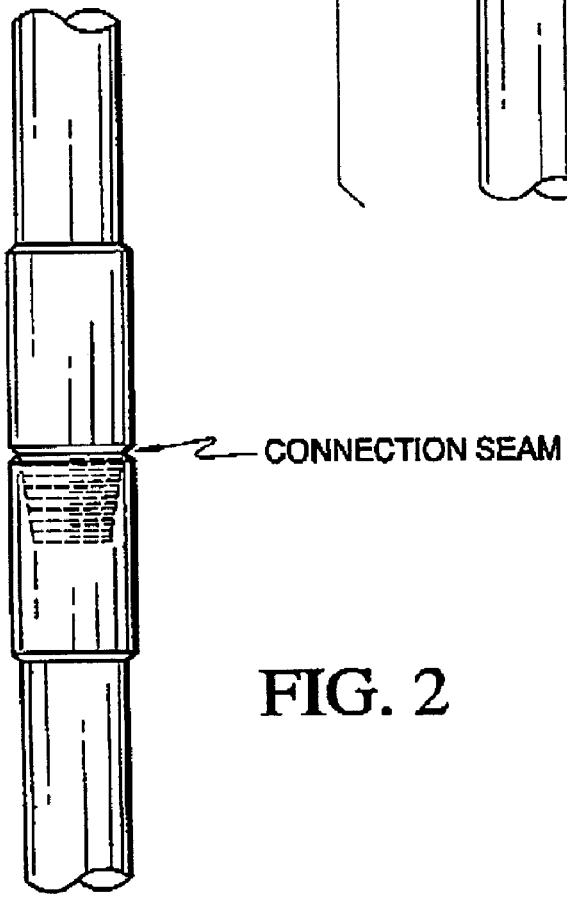
FIG. 2 shows a typical tubular threaded connection, made up (or screwed together).
Figure 3:
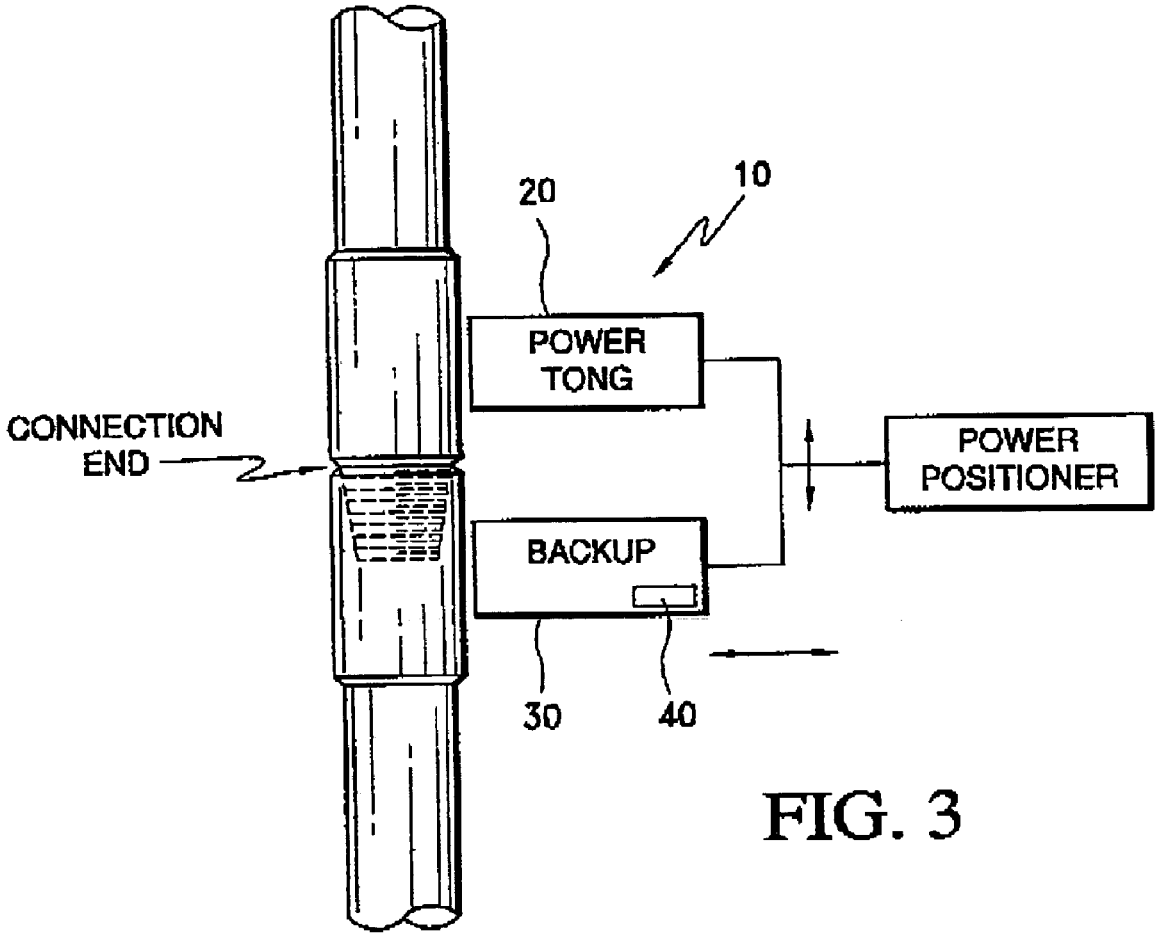
FIG. 3 is a drawing of a power tong unit (power tong and backup), a power positioner, tubular connection, and probe.

As can be seen in the accompanying FIGS. 1, threaded connections (whether on drill pipe, tubing, or casing) comprise two halves (pin and box), each having an end, and the ends forming a "seam" where the pin and box ends meet (see FIG. 2). FIGS. 1–3 illustrate a common setting for employment of the method and apparatus in a rig setting, in which the tubular is disposed substantially vertically (that is, the longitude of the tubular is vertical), typically in the rotary of a drilling or workover rig. A power tong unit 10 must be vertically positioned, as shown in FIG. 3, with the power tong 20 (the part which rotates the tubular) on one side (either above or below) of the connection seam, and the backup 30 (the part which holds the other side of the connection, either stationary or rotates it in a direction opposite to the direction of rotation of the power tong) on the other side, so that relative rotation of the two may be effected. While FIG. 3 shows power tong 20 placed above the connection seam (to grip and rotate the upper half of the threaded connection, typically the pin), with backup 30 placed below the connection seam, it is to be understood that the positions could be reversed. It can be readily appreciated that the connection end is the relevant positional reference point for proper positioning of a power tong unit.

The apparatus and method of this embodiment of the invention detects the vertical position of the threaded connection end, and emits a signal when the connection end is detected. This signal may cause an audio and/or visual alarm to be emitted, which can be used by an operator to manipulate a power positioner to longitudinally properly position a power tong unit on the connection. Alternatively, the signal can be supplied to a processor which automatically controls a power positioner to longitudinally position the power tong unit properly about the two halves of the threaded connection, about the connection seam, or on the one half (usually the box) of the connection. The basic physical principle which the apparatus and method employs is so-called "eddy current" detection of discontinuities in an electrically conducting object, as earlier described herein. For purposes of this invention, the eddy current principle is used to detect a "discontinuity" in electrically conductive tubular goods, in the form of the connection seam (the connection seam, with respect to the tubular on either side of it, being a discontinuity, in that the seam marks where two separate pieces of metal meet) or the connection end (with the absence of metal beyond the end being the discontinuity).

Various modifications to the apparatus and its method of operation may be made in order to optimize discontinuity detection for differing configurations of tubulars, material type, etc. The scope of the present invention encompasses any such methods and apparatus of using eddy current principles to detect the location of a connection end, for purposes of vertical, horizontal, or other positioning of a power tong/backup on the connection.

Figure 4:
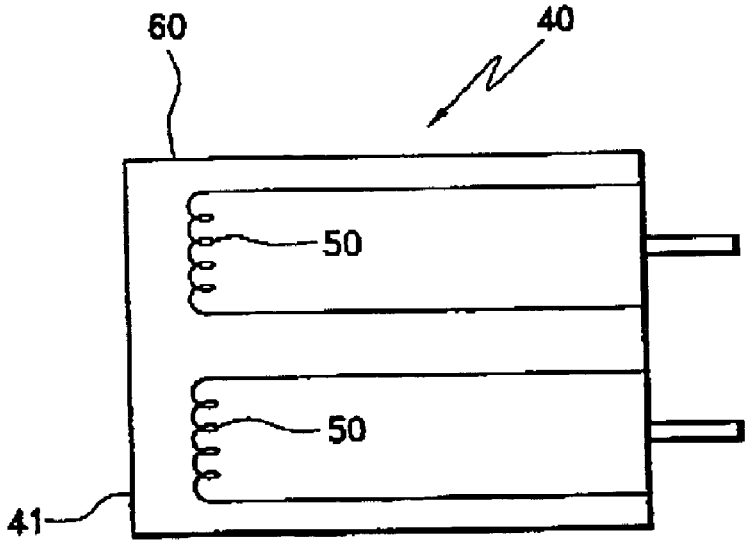
FIG. 4 is a schematic representation of one embodiment of the probe of the present invention, comprising two electric coils in an elongated housing.

As shown in FIGS. 3–6, the invention preferably comprises a probe 40 comprising at least one electric coil 50 mounted in a housing 60. FIG. 4 is a schematical exemplary drawing of probe 40, in partial cross section, and shows a presently preferred embodiment comprising two coils 50. It is to be understood that FIG. 4 is schematical in nature, and the actual physical configuration of the coils and their placement in the housing may take a number of forms, as is known to those having skill in the relevant art field; the scope of the present invention encompasses any number and configuration (size, geometry, etc.) of coils. Probe 40 is mounted on a means for moving the coil along the longitude of the tubular, which means also places probe 40 in close proximity to the tubular and moves the probe along the longitude of the tubular. In the preferred embodiment, the means for moving the coil along the longitude of the tubular on which probe 40 is mounted is a power tong unit 10, for example probe 40 being mounted on backup 30. The probe face 41 is positioned at or close to the edge of the throat 15 of power tong unit 10, typically within about ⅜" or less of the throat edge. That distance may of course be modified to accommodate particular operating conditions. This permits the probe face to be within about ½" or less of the tubular when the invention is in use. It is to be understood, however, that the scope of the present invention includes embodiments where the coil is carried by apparatus other than the power tong unit, for example some arrangement of movable carrier dedicated to the probe positioning function.

Figure 5:
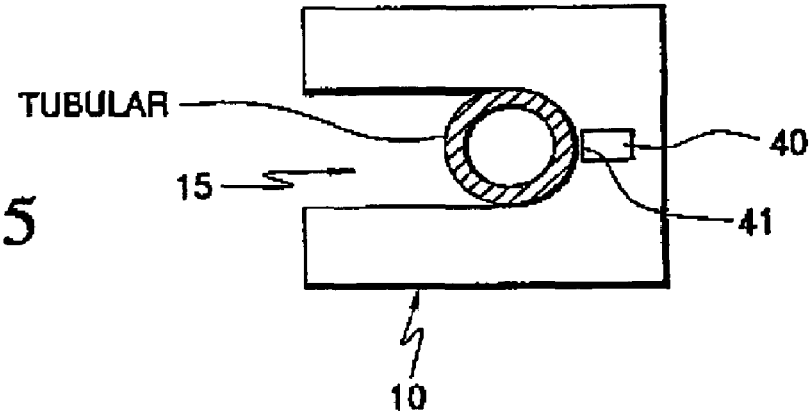
FIG. 5 is a top view showing the probe mounted on the power tong unit, and a tubular in position within the throat of the power tong unit.

FIG. 5 is a top view of probe 40 positioned in power tong unit 10. FIG. 5 also shows a tubular (in cross section) in position within the throat of power tong unit 10, for example against the rearward surface of the throat, and thereby positioned sufficiently close to probe face 41 to be within the magnetic field emanating therefrom, as later described.

Figure 6:
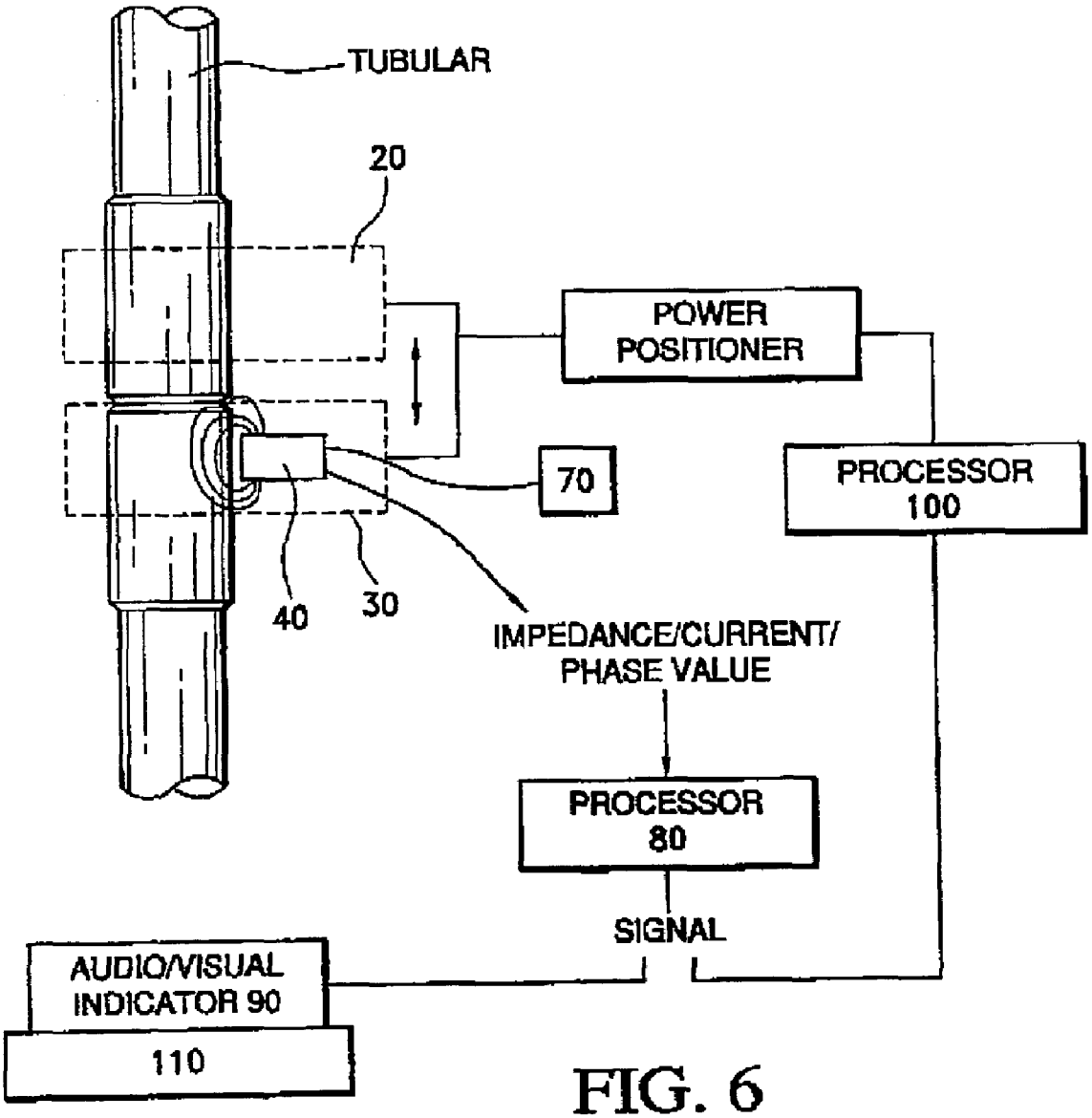
FIG. 6 shows the various components of the invention.

FIG. 6 shows an exemplary arrangement of the apparatus of the present invention. An electric current source 70, preferably a radio frequency alternating electric current source, supplies a radio frequency electric current to probe 40. As is later described, a means for detecting a change in the electro-magnetic field of coil 50 as it moves along the longitude of the tubular is provided, which can comprise a first processor 80 measuring impedance, current, and phase angle for the electric current flow through the electric coil. A means for moving electric coil 50 parallel to the longitude of the tubular can comprise power tong unit 10 moved by the power positioner. Processor 80 is coupled to an indicator 90, which may have audio and/or visual output when a change indicative of a connection end is detected. Processor 80 may additionally be coupled to a second processor 90, in turn coupled to the power positioner, which positions power tong unit 10 both horizontally and vertically (along the longitude of the tubular). Indicator 90 is typically mounted on a control console 110, which also typically contains manual controls for the power positioner as well as for power tong unit 10 (e.g., the throat door, rotary, etc. of the power tong and backup).

USE OF THE APPARATUS

An exemplary sequence of steps in the use of the invention can now be described.

A power positioner is actuated so as to advance probe 40, in the presently preferred embodiment carried by power tong unit 10, horizontally toward a tubular. Power tong unit 10 is moved so that probe face 41 is close enough to the tubular that the tubular will be within the electro-magnetic field emanating from probe 40, as can be seen in FIG. 6, and as later described. Typically, probe face 41 will be set back around ⅜" from the rearward surface of tong throat 15; when the power tong unit is advanced until the rearward surface of the throat butts up against the tubular, then the tubular will be within ½" or so of probe face 41. This spacing suffices for most configurations of probe 40, tubular material, etc., but obviously can be modified if needed.

Figure 7:
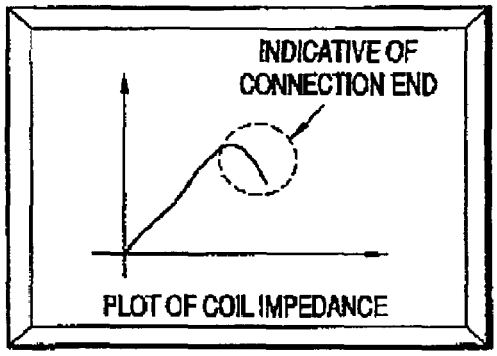
FIG. 7 is an example of a video output of the impedance measurement.

An electric current, preferably an alternating current, is flowed by electric current source 70 through electric coils 50 within probe 40, generating the electro-magnetic field earlier described. The means for moving electric coil 50 along the longitude of the tubular, in the illustrated embodiment being power tong unit 10 (as electric coil 50 is mounted thereon) moved by the power positioner, is then activated, under either automatic or manual control, to move probe 40 along the longitude of the tubular. Processor 80 is monitoring changes in the electro-magnetic field, including impedance, current and phase angle through the electric coil. Advantageously, impedance can be visually output on an oscilloscope-type screen as probe 40 advances along the tubular. FIG. 7 shows a typical impedance display. When probe 40 moves to a position in which a connection end is within the magnetic field, an impedance change is noted, as shown on the exemplary plot of FIG. 7 in the area so noted. Of course, other useful values can be so plotted and used to note position of the connection end. The characteristic impedance signature of the connection end can be readily established empirically, by a test case on a connection end.

Processor 80, upon detecting the presence of a connection end, generates a signal which is sent to indicator 90, as represented in FIG. 6. Indicator 90 may be visual (a signal light), audio, or a combination. When the power positioner is under manual control, upon receiving the signal the operator can adjust the position of power tong unit 10 along the longitude of the tubular by a known, fixed amount (which can also be established empirically), to place power tong unit 10 properly on the connection.

Alternatively, the signal from processor 80 can be sent to and received by a second processor 100, which controls the power positioner. Upon receiving the signal from processor 80 denoting the location of the connection end, the relative vertical position of power tong unit 10 is recorded by processor 100. Then, processor 100 signals the power positioner to raise or lower power tong unit 10 by a fixed amount (which is calibrated, and dependent upon the physical arrangement of the probe, the power tong unit, etc.) to properly place power tong unit 10 on the connection.

Once properly positioned along the longitude of the tubular, with respect to connection end, the tong throat door can be closed, the jaws advanced to grip and turn the connection to makeup or breakout the threaded connection as needed.

The method of the present invention therefore comprises the steps of:

- providing a probe comprising an electric coil, operatively connected to means for moving the electric coil along the longitude of a tubular, such as a power tong unit carried by a power positioner;
- flowing an alternating electric current, preferably a radio frequency alternating electric current, through the electric coil, while the electric coil is positioned sufficiently close to a tubular that the tubular is within the electro-magnetic field generated by the electric current flow through the electric coil;
- moving the tubular and the electric coil relative to one another, along the longitude of the tubular, whether by moving the tubular with the coil held stationary or by moving the coil with the tubular held stationary, a sufficient distance that the connection end is moved within the electro-magnetic field;
- detecting the presence of the connection end by monitoring changes in the electro-magnetic field, represented by changes in impedance, current and/or phase angle and sensing a change in those values, caused by the connection end;
- emitting a signal when the connection end is detected, the signal causing a visual and/or audio alarm to be given;
- from the longitudinal position of the power tong unit when the alarm is given, adjusting the position of the power tong unit by a pre-determined amount to a position where the power tong can grasp the connection for makeup or breakout.

ANOTHER PRESENTLY PREFERRED EMBODIMENT OF THE APPARATUS AND METHOD

Figure 8:
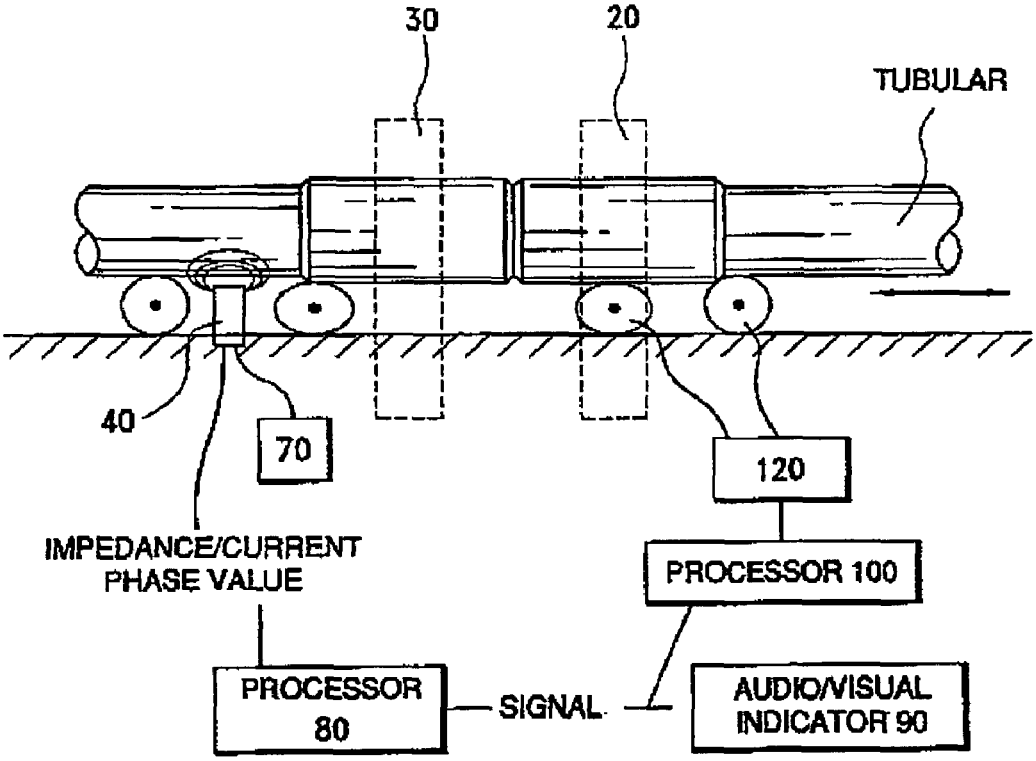
FIG. 8 shows another embodiment of the invention.

FIG. 8 shows another preferred embodiment of the apparatus. In this embodiment, the tubular is disposed substantially horizontal, and the power tong unit is correspondingly disposed so as to grasp the horizontal tubular. This embodiment of the invention has particular utility in so-called "shop" environments, where tubulars such as bottom-hole assemblies may be advantageously madeup before being sent out to a drilling rig.

In this embodiment, the tubular is disposed substantially horizontally. A means for moving the tubular in a direction parallel to its longitude, for example a power roller 120, is provided to permit moving the tubular back and forth horizontally past probe 40 (which comprises electric coil 50). Power tong unit 10 is disposed such that its axis of rotation is also substantially horizontal. Probe 40 can be mounted either in power tong unit 10 (for example, on backup 30, as in the previous embodiment), or simply fixedly mounted as to hold probe face 41 within the required distance from the tubular. In other respects, this embodiment is similar in operation to the previously disclosed embodiment. An alternating electric current source 70, preferably a radio frequency alternating current, flows electricity through the electric coil or coils in probe 40. The tubular is moved along by power roller 120, within the electro-magnetic field emanating from probe 40. A means for detecting changes in the electro-magnetic field is provided, such as processor 80 receiving a signal (impedance, current, and phase angle) from probe 40, and when the characteristic signal signature is detected for a connection end a signal is send to audio and/or visual indicator 90, and/or to processor 100, in this embodiment controlling power roller 120. Power roller 120 therefore moves the tubular horizontally so as to place the connection seam in the proper location for makeup and/or breakout.

The method corresponding to this embodiment therefore comprises the steps of:

providing a probe comprising an electric coil;

flowing an alternating electric current, preferably a radio frequency alternating electric current, through the coil, while a tubular is positioned within the electro-magnetic field generated by the electric current flow through the electric coil;

moving the tubular longitudinally relative to the coil, whether by moving the tubular with the coil held stationary or by moving the coil with the tubular held stationary, a sufficient distance that the connection end is moved within the electro-magnetic field;

detecting the presence of the connection end by monitoring coil impedance, current, and phase angle and sensing a change in those values, caused by the connection end;

emitting a signal when the connection end is detected, the signal causing a visual and/or audio indication to be given;

from the longitudinal position of the power tong unit when the indication is given, adjusting the position of the tubular by a pre-determined amount to a position where the power tong can grasp the tubular for makeup or breakout.

OTHER EMBODIMENTS OF THE INVENTION

The present invention encompasses various embodiments and changes that may be appropriate to adapt the apparatus and method to particular physical settings, e.g. different tubulars, power tong/backup combinations, environmental conditions, etc. It will be recognized by those having skill in the relevant art field that at least the following characteristics of the method and apparatus may be varied as needed, all within the scope of the present invention:

operating frequency of the alternating current supplied to the electric coil;

distance of the probe/coil from the tubular;

rate at which the probe/coil is moved with respect to the tubular and the connection seam;

shape and geometry of the probe/coil(s);

the number of coils in the probe, including, the use of multiple "differential coils"; and different processor means to receive and transmit information regarding coil impedance, current, and phase angle; height of connection seam; and height of power tong unit.

It is to be understood also that the method and apparatus of the present invention may be used on tubulars in which the longitudinal axis is neither vertical nor horizontal, but at some inclination (e.g. 45 degrees from vertical), to suit particular applications, such as a tubular being in a mousehole or rathole on a drilling rig; or to make up and breakout tubulars being used to create waterway crossings (in which the borehole is drilled at a very steep angle, to create a borehole underneath a river, for example).

It should be appreciated that an apparatus and method for determining the position of a connection seam, for positioning of a power tong unit properly on the threaded connection, in accordance with the teachings of the present inventive disclosure, constitutes an advancement in the relevant art. While the above description contains certain specificities, these should not be construed as limitations on the scope of the invention, but rather only as examples of presently preferred embodiments thereof. Accordingly, the various elements of the invention should be understood as including alternative structures and methods which those skilled in the relevant art would recognize as equivalent.

The scope of the invention should therefore be measured not by the examples given, but by the scope of the appended claims and their legal equivalents.

We claim:

1. An apparatus for positioning a power tong unit at a desired position along the longitude of an electrically conductive tubular, comprising:

a) an electric coil operatively connected to a source of alternating electric current, thereby creating an electro-magnetic field therearound, said electric coil adapted to be placed radially with respect to and sufficiently close to an electrically conductive tubular so that said electro-magnetic field is influenced by the presence of said tubular;

b) a means for moving said electric coil in a direction parallel to the longitude of said tubular, while said electric coil remains at a substantially constant distance from an outer surface of said tubular;

c) a means for detecting a change in said electro-magnetic field of said electric coil in response to movement of said electric coil in a direction parallel to the longitude of said tubular, said means for detecting comprising a digital processor, and wherein said change in said electro-magnetic field comprises a change in at least one of impedance, current, and phase angle of said alternating electric current and wherein said change results from a connection end of said tubular within said electro-magnetic field, said change comprising data from which a height of said connection end above a datum may be determined;

d) a power tong unit, comprising a power tong and a backup unit;

e) a means for positioning said power tong unit at a desired position along a line parallel to the longitude of said tubular, said means for positioning operatively coupled to said means for detecting a change in said electro-magnetic field of said electric coil, and thereby positioning said power tong unit at said height above said datum corresponding to said connection end in response to a said change in said electro-magnetic field of said electric coil.

2. The apparatus of claim 1, wherein said electric coil is mounted on said power tong unit.

3. The apparatus of claim 2, wherein said alternating current is a radio frequency alternating current, and wherein said change in said electro-magnetic field is indicative of a connection end.

4. The apparatus of claim 3, wherein said means for positioning said power tong unit is coupled to said means for detecting a change in said electro-magnetic field indicative of a connection end.

5. The apparatus of claim 1, wherein said apparatus comprises at least two electric coils.

6. An apparatus for positioning a connection end with respect to a power tong unit, to enable makeup and breakout of the connection, comprising:

a) an electric coil operatively connected to a source of alternating electric current, thereby creating an electro-magnetic field there around, said electric coil adapted to be placed radially with respect to and sufficiently close to an electrically conductive tubular so that said electro-magnetic field is influenced by the presence of said tubular;

b) a means for detecting a change in said electro-magnetic field of said electric coil in response to movement of said tubular by said electric coil, said means for detection comprising a digital processor, and wherein said change in electro-magnetic field comprises a change in at least one of impedance, current, and phase angle of said alternating electric current and wherein said change results from a connection end of said tubular within said electro-magnetic field, said change comprising data from which a location of said connection end above a datum may be determined;

c) a power tong unit, comprising a power tong and a backup unit; and d) a means for moving said tubular in a direction parallel to the longitude of said tubular, past said electric coil, in response to said change in said electro-magnetic field of said electric coil and positioning said tubular at said location with respect to said datum corresponding to said connection end.

7. The apparatus of claim 6, wherein said alternating current is a radio frequency alternating current, and wherein said change in said electro-magnetic field is indicative of a connection end.

8. The apparatus of claim 7, wherein said means for moving said tubular is coupled to said means for detecting a change in said electro-magnetic field indicative of a connection end.

9. The apparatus of claim 8, wherein said means for moving said tubular comprises a powered roller.

10. The apparatus of claim 9, wherein said apparatus comprises at least two electric coils.

11. A method for positioning a power tong unit longitudinally along a tubular, with respect to the position of a threaded connection seam or end, comprising the steps of:

a) providing a power tong unit comprising; an electric coil mounted thereon; a source of alternating electric current connected to said electric coil; a means for detection a chance in said electro-magnetic field of said electric coil, said means for detecting comprising a digital processor, in response to movement of said electric coil in a direction parallel to the longitude of said tubular, and wherein said change in said electro-magnetic field comprises a chance in at least one of impedance, current, and phase angle of said alternating electric current;

b) positioning said electric coil, through which an alternating electric current is being flowed, sufficiently close to a tubular that said tubular is within an electro-magnetic field emanating from said coil;

c) moving said electric coil along the longitude of said tubular, while said electric coil remains at a substantially constant distance from an outer surface of said tubular, until a threaded connection seam or end is within said electro-magnetic field;

d) detecting a change in said electro-magnetic field, caused by the presence of said threaded connection end therein, wherein said change in said electro-magnetic field comprises a change in at least one of impedance, current, and phase angle of said alternating electric current, and wherein said change is detected by a digital processor;

e) generating a signal when said change is detected, and sending said signal to a processor, said signal comprising data from which a height of said connection end above a datum may be determined; and f) emitting a signal from said processor to a power positioner holding a power tong unit, said power positioner positioning said power tong unit along a longitude of said tubular such that said threaded connection may be gripped by said power tong unit, for makeup or breakout of said threaded connection.

12. The method of claim 11, wherein said alternating electric current is a radio frequency alternating electric current.

13. A method for longitudinally positioning a threaded connection seam or end in relation to a power tong unit, comprising the steps of:

a) positioning an electric coil, through which an alternating electric current is being flowed, sufficiently close to a tubular that said tubular is within an electro-magnetic field emanating from said coil;

b) moving said tubular longitudinally past said electric coil, until a threaded connection end is within said electro-magnetic field;

c) detecting a change in said electro-magnetic field, caused by the presence of said threaded connection end therein, wherein said change in said electro-magnetic field comprises a change in at least one of impedance, current, and phase angle of said alternating electric current, and wherein said change is detected by a digital processor;

d) generating a signal when said change is detected, and sending said signal to a processor, said signal comprising data from which a longitudinal distance of said connection end from said power tong unit may be determined; and e) emitting a signal from said processor to a tubular positioner, said tubular positioner moving said tubular along its longitude such that said threaded connection may be gripped by said power tong unit, for makeup or breakout of said threaded connection.

14. The method of claim 13, wherein said alternating electric current is a radio frequency alternating electric current.

* * * * *